United States Patent [19]

Ferguson

[11] Patent Number: 4,989,771

[45] Date of Patent: Feb. 5, 1991

[54] FORMS FEEDING APPARATUS

[75] Inventor: Gregory A. Ferguson, New Bedford, Mass.

[73] Assignee: Precision Handling Devices, Inc., Fall River, Mass.

[21] Appl. No.: 200,486

[22] Filed: May 31, 1988

[51] Int. Cl.[5] ..... B65H 20/20

[52] U.S. Cl. ..... 226/74

[58] Field of Search ..... 226/74, 75, 87

[56] References Cited

U.S. PATENT DOCUMENTS

| | | | |
|---|---|---|---|
| 2,633,354 | 3/1953 | Mixer | 226/75 |
| 3,746,228 | 7/1973 | Arnold | 226/75 |
| 3,859,864 | 1/1975 | Offermann | 74/299 |
| 3,938,721 | 2/1976 | Staneck et al. | 226/75 |
| 4,316,567 | 2/1982 | Grear et al. | 226/87 X |
| 4,481,005 | 11/1984 | Mann, Jr. | 474/139 X |
| 4,569,468 | 2/1986 | Neer | 226/74 |
| 4,682,904 | 7/1987 | Yoshimura | 226/74 X |
| 4,714,185 | 12/1987 | Hubbard | 226/74 |

FOREIGN PATENT DOCUMENTS

| | | |
|---|---|---|
| 54-65967 | 5/1979 | Japan . |
| 858501 | 1/1961 | United Kingdom . |
| 1558124 | 12/1979 | United Kingdom . |
| 2104491 | 3/1983 | United Kingdom . |

*Primary Examiner*—Katherine Matecki

*Attorney, Agent, or Firm*—Martin Lukacher

[57] ABSTRACT

A tractor for feeding perforated paper forms as in a printer, to and around a platen where a print head impresses characters or other symbols on the paper. The tractor has an endless belt with pins engageable in the paper before, during and after engagement with a drive sprocket which drives the belt in such a manner that the load on the paper is polarized to one side of the drive sprocket, preferably the side between the drive sprocket and the platen. The tractor has guide members (idler sprockets or shoes) on opposite sides of the drive sprocket which define a generally triangular path for the belt with the belt engaging the sprocket only on one reach of the belt so that the load on the belt is relieved where the paper enters the tractor; the belt there being in an unstressed, relatively slack condition so that the pitch (spacing) between the pins can vary as by flexure of the belt or tilting of the pins, allowing the pins to enter the perforations in the paper without damaging the perforations or walking out of the perforations after entry.

14 Claims, 6 Drawing Sheets

FORMS FEEDING APPARATUS

DESCRIPTION

The present invention relates to forms feeding apparatus and particularly to tractor apparatus for feeding perforated forms.

The invention is especially suitable for use in printers for feeding perforated forms for printing in the printer. Aspects of the invention may also be used wherever the driving of perforated webs is desired.

Perforated forms feeding tractors have belts, with pins which enter the perforations in the forms, and sprockets for driving the belts. Such tractors are conventionally used in printers and for other paper feeding applications. Reference may be had to Hubbard U.S. Pat. Nos. 3,825,162, 4,129,239, 4,421,261, and 4,714,185 for various types of such forms feeding tractors. While such tractors are generally satisfactory, they are under certain circumstances subject to a mode of operation wherein the form walks out of the pins especially where a platen or other paper driving device ahead of (downstream of) the tractor moves the paper at a higher speed than the tractor. Then the tension in the belt may become variable, for example, oscillating from pulling to pushing tension with respect to the paper. In order to prevent the pins from moving out of the paper and also in order to assure that a sufficient number of pins are in contact with the paper and disposed in the perforations, tractors which are especially designed for accurate feeding and/or high speed feeding have been provided with a large number of pins. Another approach has been to use sets of tractors, one pair upstream and the other downstream of the platen. Alternatively, so-called "bi-directional" tractors have been used where the paper is engaged with the belt on opposite reaches thereof, upstream and downstream of the platen. Reference may be had to U.S. Pat. No. 3,859,864 issued Jan. 14, 1975 for a bi-directional tractor system. An important improvement in tractor design which reduces the problem is found in the above-referenced Hubbard et al. U.S. Pat. No. 4,714,185 wherein the tractor defines a wrap angle for the paper around the belt so as to increase the mechanical coupling between the belt and the paper and reduce the reliance on the pins.

The advantages of increased mechanical coupling are retained in tractor apparatus provided in accordance with this invention. In addition the invention is operative to isolate a section of the belt which carries the load from a section where the paper enters the tractor and is positioned on the pins. The belt is maintained sufficiently slack in the entry section so that, by virtue of the flexibility in the belt, the pins can vary their spacing, (pitch) as by tilting or as the belt flexes to enable the pins to enter the perforations. Accordingly, when the paper is on the load bearing section of the tractor, it cannot move or walk off the pins. Fewer pins can do the duty of a larger number thereby enabling the tractor to be reduced in size so as to be accommodated in smaller printers.

Accordingly it is the principal object of this invention to provide improved tractor apparatus for feeding perforated paper, computer forms or other webs, and which is especially adapted to operate in a braking mode with a platen or other device which feeds the paper at a greater speed than the tractor, and is nevertheless adapted to maintain accurate and even high speed feeding of the paper by avoiding damage to the perforations, or the need for large, driving torques and the motors and drive trains necessary to provide such torques.

Briefly described, a tractor for feeding paper with perforations spaced at a given pitch, which embodies the invention, uses an endless belt having pins spaced at the pitch of the perforations. The belt also has spaced lugs on the opposite side of the belt from the pins. The belt is characterized as being flexible enough to enable the pitch between the pins to vary when the belt is in unstressed condition. A belt drive sprocket is provided having spaced receptacles along its outer periphery for receiving the lugs. The sprocket is preferably of sufficient diameter with respect to the spacing of the lugs to engage a plurality of lugs. The sprocket and path defining means, such as shoes or idler sprockets, define a generally triangular path with the sprocket in the center thereof. The center sprocket defines belt sections on opposite sides thereof and polarizes the load to one of these sections, which may have a length longer than the other sections, so as to contain more pins therein. The load is polarized to the load bearing section and the belt in the other section is left unstressed so as to enable the pins to move as by tilting or flexing of the belt so as to enter the holes in the perforations. By the time the paper reaches the sprocket and enters the load bearing section, the pins are firmly disposed in the paper. Both sections may be straight and the sprocket may be of sufficient diameter so as to provide increased mechanical coupling due to the wrap of the paper on the belt as it travels around the sprocket. The foregoing and other objects, features and advantages of the invention as well as a presently preferred embodiment thereof will become more apparent from a reading of the following description in connection with the accompanying drawings in which:

Figure 1:
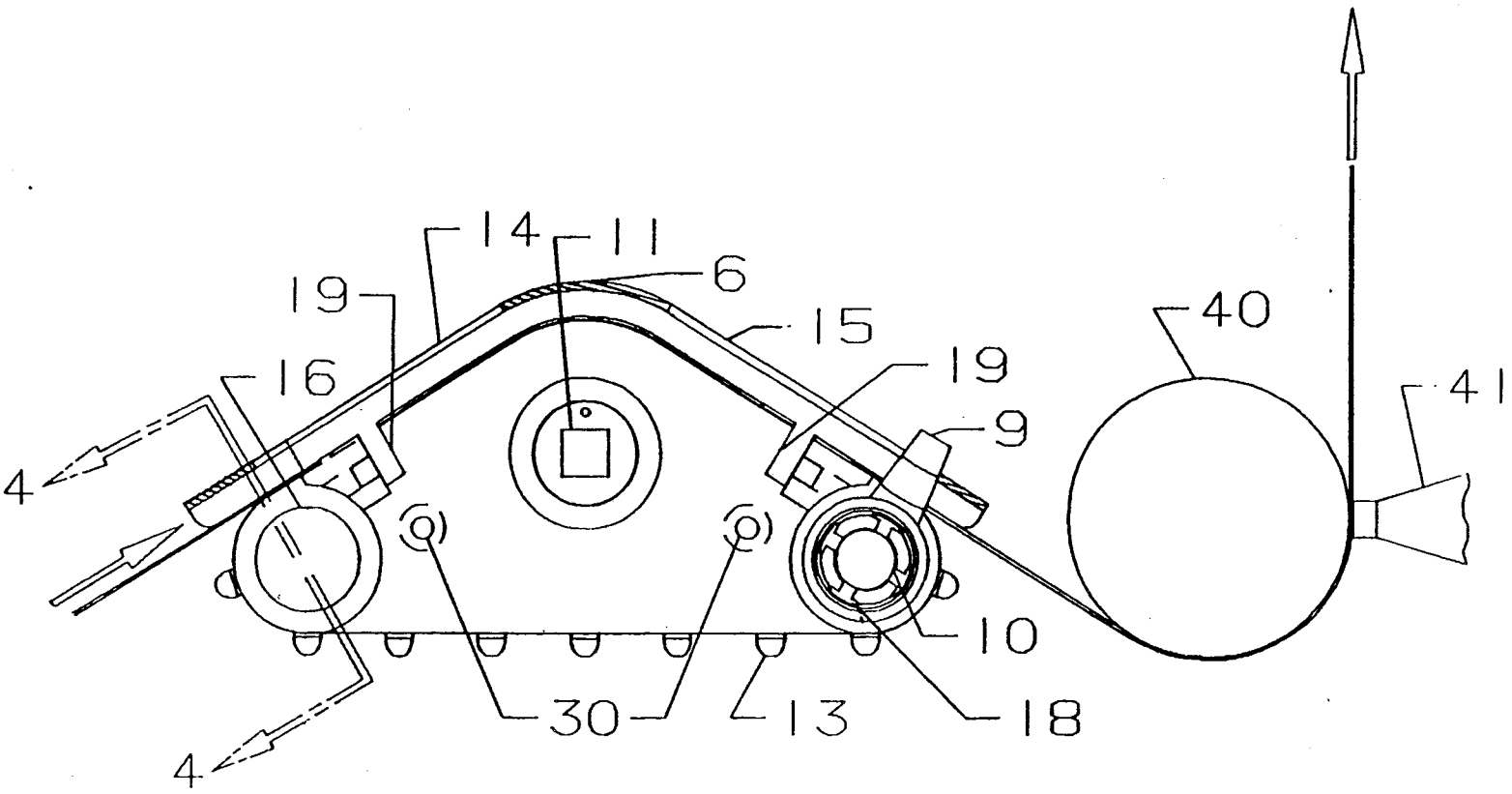
FIG. 1 is an elevational view showing tractor apparatus in accordance with an embodiment of this invention and schematically illustrating a platen roller and print head of a printer which may be used in combination therewith.
Figure 2:
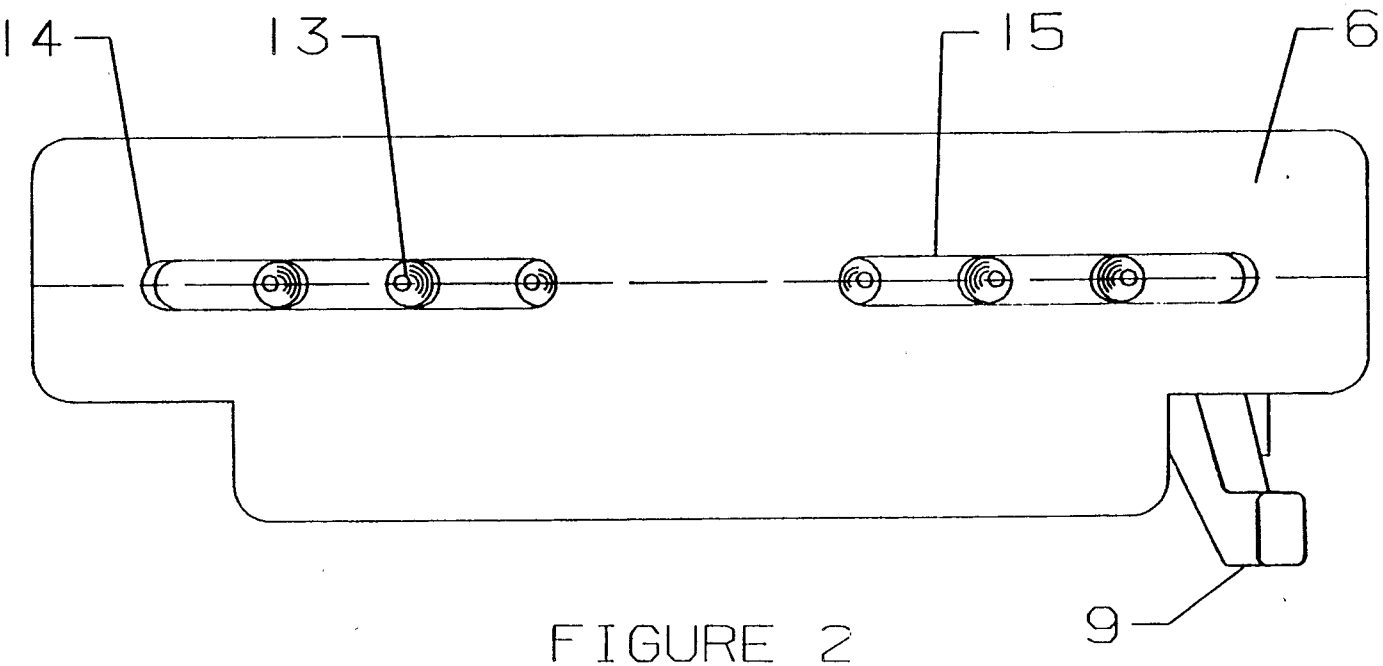
FIG. 2 is a plan view of the tractor shown in FIG. 1.
Figure 3:
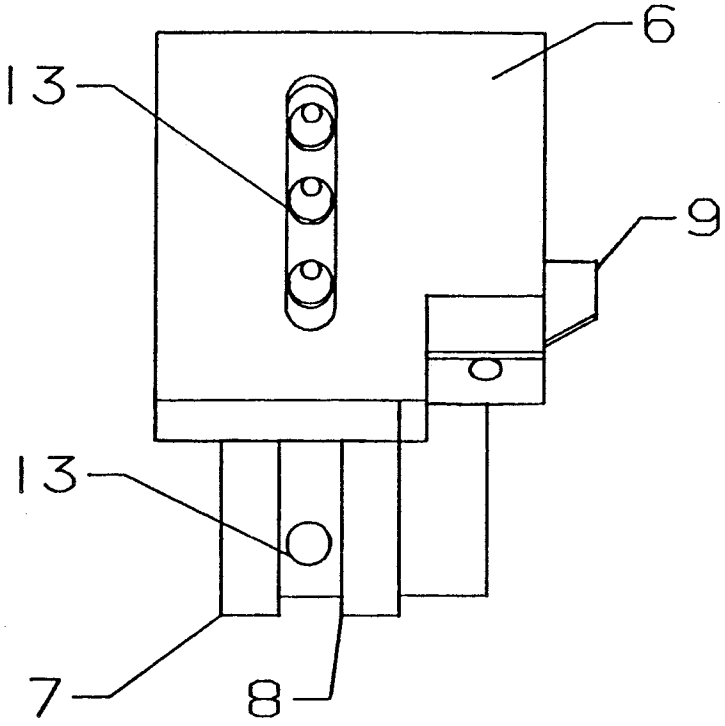
FIG. 3 is an end view of the tractor shown in FIG. 1.
Figure 4:
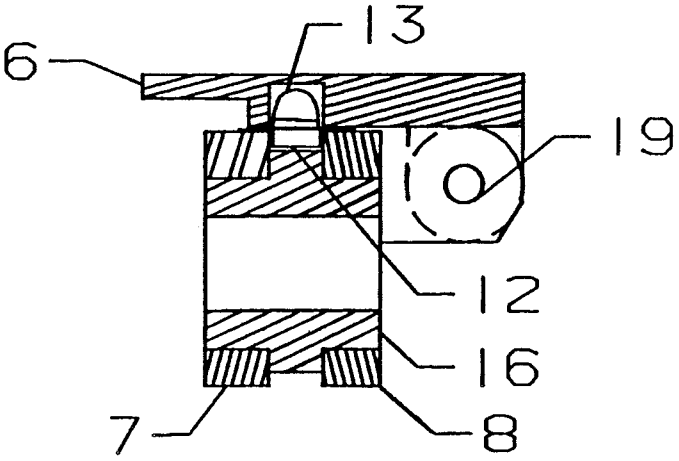
FIG. 4 is a sectional view taken along the line 4—4 in FIG. 1.
Figure 5:
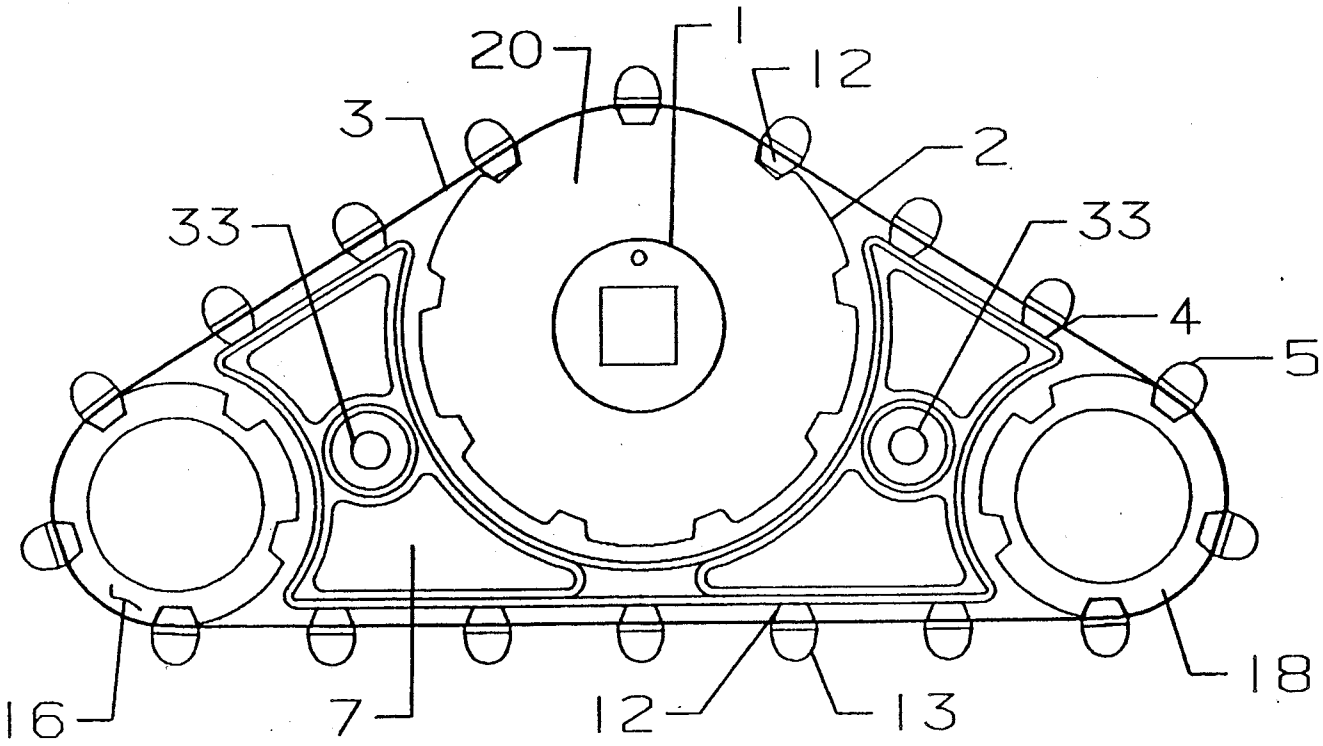
Figure 6:
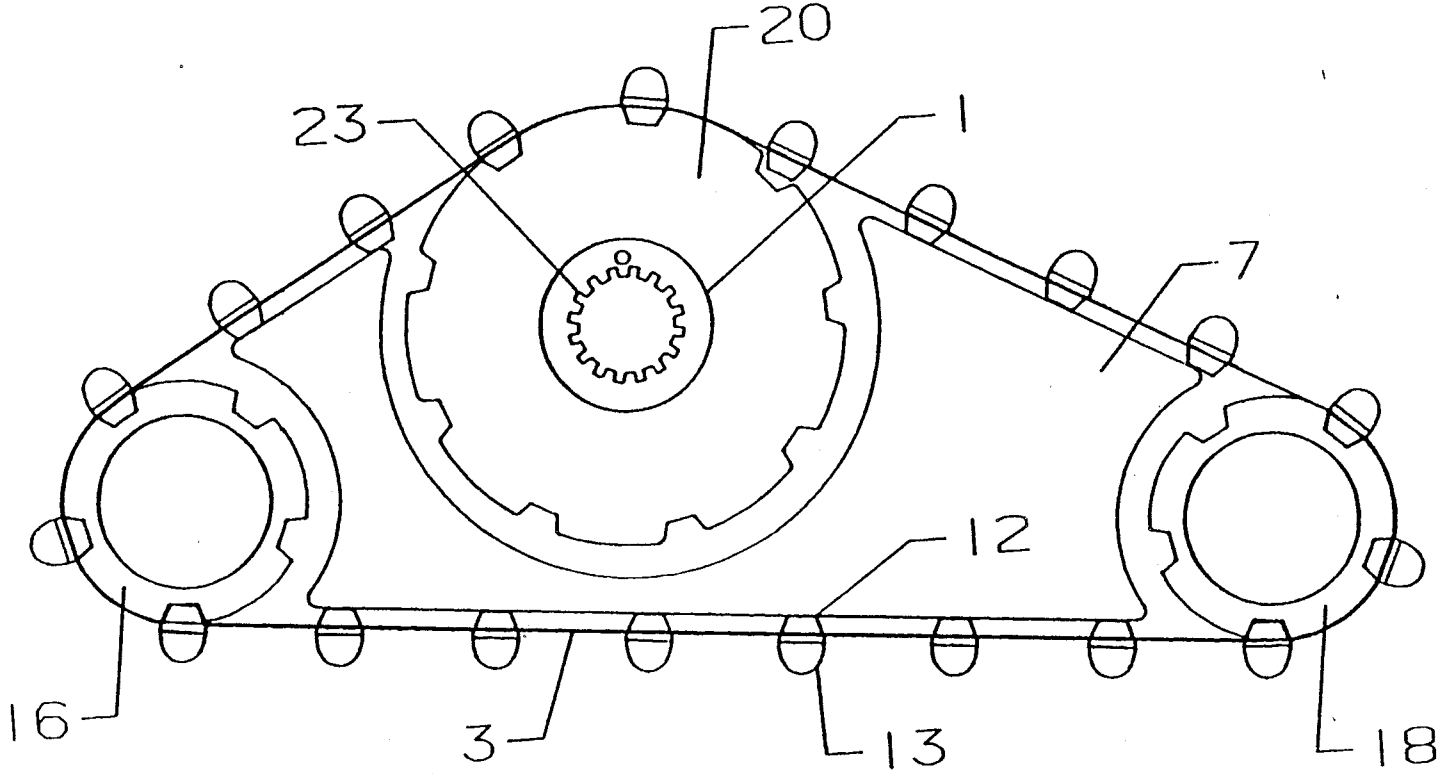

FIG. 5 is a view of the tractor shown in FIG. 1 with the cover or lid removed and with the outside side plate removed to illustrate the sprocket, idlers and inside side plate; and FIG. 6 is a view, similar to FIG. 5, showing another embodiment of the invention. Referring to FIGS. 1 to 5 there is shown a tractor which is used in a braking mode disposed upstream of a platen roller 40 against which printing is carried out on the paper, which is driven by the tractor and the roller 40, by a print head 41. This print head may be part of a band printer, a dot matrix printer, daisy wheel or other printing head mechanism which impresses or deposits symbols or portions of symbols on the paper. These symbols are usually alphanumerics, but may be other symbols. The platen roller in the braking mode drives the paper at a higher linear speed than the tractor, although the tractor may be designed to pull the paper from a paper supply not shown but which is located to the left in FIG. 1. Then the tractor assures that the paper is driven, usually stepwise, with a stepping motor coupled to the tractor at the line printing speed dictated by the printer control circuits.

The tractor has inside and outside side plates 7 and 8. One of these plates may be formed with spacers as is shown in FIG. 5 so that when assembled, by screws or other fasteners 30 which extend through holes 33, the side plates are spaced from each other. The plates contain openings in which a drive sprocket 20 and idler sprockets 16 and 18 are journalled. The drive sprocket 20 may have a central pulley 1 having a square or fluted (as shown at 23 in FIG. 6) hole 11 for receiving the drive shaft of the motor or gear train which drives the tractor. The outside or gear section 2 of the sprocket is formed with teeth which define receptacles for the lugs 12 on the inside of the belt 3 of the tractor. Opposite to the lugs are pins 13. The belt may be made of elastomeric material and consist essentially of such material. Such tractor belts are in common use and are shown in many tractors, for example, such as illustrated in U.S. Pat. No. 4,469,263. Preferably, however, the belt is a thin, flexible band or strip of polyamide such as sold under the tradename "Kapton" by the E. I. DuPont deNemours Company of Wilmington, Del. Such belts are described in the above-referenced Hubbard patents. These belts are characterized by their material being sufficiently flexible so as to change the spacing or pitch between the pins when they are unstressed or relatively slack. Of course when the belt is under tension, as when the belt is carrying a load, the pitch is preserved and the belt does not change dimension between the pins.

It is an important feature of this invention to provide a tractor which is polorized. The section of the belt is isolated by the sprocket 20 from the entry section so as to enable the belt there to become sufficiently slack and allow the flexibility thereof to permit the pins to either tilt or move toward or away from each other and enter the perforations in the paper.

The section which is load bearing is disposed to the right of the sprocket between the sprocket 20 and the idler 18. The relatively slack or untensioned section of the belt 3 is to the left of the sprocket between the sprocket and the other idler 16. The third section between the idlers 16 and 18 and below the sprocket is spaced from the sprocket so that the pins do not enter the sprocket receptacles. The belt path is generally triangular.

In the embodiment shown in FIGS. 1 through 5 the triangular shape is generally that of a isosceles triangle with the sections defined between the sprocket 20 and the idlers 16 and 18 of approximately equal length. The load bearing section may be made longer as shown in FIG. 6 thereby allowing more pins to be provided for carrying the load. In the limit, which has been found a preferable minimum size of the tractor, there may be three pins on the load bearing or tension side and two pins on the slack or untensioned side with one pin shared between the two sides, that pin being on the sprocket 20.

In the three sections between the idlers 16 and 18 and between each idler 16 and 18 and the sprocket 20, the frame provides a support surface for the belt which is essentially flat and straight, such that the belt path is straight in each of these sections. The lugs are desirably proportioned in size to the pins such that during loading they tip to distribute the load and during low-tension entry to the form they tip to avoid damage to the form. For example, the lugs may have dimensions along the path of travel of the belt greater than the diameter of the pins at the belt.

While the embodiment shown in illustrations of the invention use idler sprockets 16 and 18, other curved guide members may be used, such as guide shoes, as are used in conventional tractors where the sprockets and idlers, or shoes, are at opposite ends thereof.

A lid or cover 6 is pivotally mounted on hinges 19 on the outside side frame and defines a gap between the belt and the cover through which the paper passes. The cover may have openings 14 and 15 where the pins are exposed.

A support shaft may extend through the opening in the idler 18, this support shaft is clamped to the tractor by a collet clamp, somewhat similar to that shown in the above-referenced Hubbard U.S. Pat. No. 4,129,329 where the spring fingers of the collet 10 extend from the side frame 7 through the side frame 8 and are encompassed by a camming ring actuated by a handle 9.

The invention provides the necessary separation of forces acting on the system by the polarizing effect of the intermediate drive sprocket 20. This sprocket provides for a low load entry of the pins into the perforations of the form on one side of the drive sprocket while taking up the remaining load with a plurality of pins on the other side of the sprocket.

While preferred embodiments of the invention are described above, variations and modifications thereof within the scope of the invention will undoubtedly suggest themselves to those skilled in the art. Accordingly, the foregoing description should be taken as illustrative and not in a limiting sense.

I claim:

1. A tractor for feeding paper with perforations spaced at a given pitch which comprises an endless belt having pins spaced at said pitch which enter the perforations and also having spaced lugs, said pins and lugs being respectively disposed on first and second sides of said belt which are opposite to each other, said belt being subject to a load due to force applied thereto by said paper and being characterized as being sufficiently flexible to enable the pitch between said pins to vary when said belt is in unstressed condition when said load is released, a belt drive sprocket having an outer periphery, spaced receptacles along said outer periphery, said sprocket being of sufficient diameter with respect to the spacing of said lugs to engage a plurality of adjacent ones of said lugs, means ahead of and behind said sprocket in the direction of movement of said belt and engagable with said second side of said belt for defining a path for said belt extending around said sprocket and said path defining means, said path having first, second and third sections defined by said sprocket and said path defining means in which the load is polarized between said first and second sections such that one of of said first and second sections is stressed while the other is in the unstressed condition for a low load entry of said pins on said belt in said other of said sections into said perforations, said first and second sections both being engagable simultaneously with the paper and being disposed between said sprocket and said path defining means, and said third section being disposed between said first and second sections and being spaced from said drive sprocket such that said belt in said third section is out of engagement with said drive sprocket.

2. The tractor according to claim 1 further comprising a lid movable to a position over said sprocket and over said first and second sections and defining a gap through which said paper can pass.

3. The tractor according to claim 1 wherein said belt consists essentially of elastomeric material to provide it with said sufficiently flexible characteristic.

4. The tractor according to claim 1 wherein said belt is of thin, flexible material to provide it with said sufficiently flexible characteristic.

5. The tractor according to claim 4 wherein said thin, flexible material is a band of polyamide plastic.

6. The tractor according to claim 1 wherein said path defining means are first and second members defining curved surfaces around and against which said belt is disposed.

7. The tractor according to claim 6 wherein said members are rotatable idler sprockets having receptacles for receiving said lugs.

8. The tractor according to claim 6 wherein said members and said sprocket form said path into a generally triangular configuration having apexes at which said members and sprocket are disposed.

9. The tractor according to claim 1 wherein said first section is of less length than said second section and includes fewer pins than said second section.

10. The tractor according to claim 1 wherein said first and second sections are essentially straight.

11. The tractor according to claim 1 further comprising means providing support surfaces for said belt on which said lugs are disposed in said sections, said lugs having flat surfaces disposed against said support surfaces.

12. The apparatus according to claim 11 wherein said lugs have dimensions along the path of travel of said belt greater than the diameter of said pins.

13. Forms feeding apparatus which comprises a tractor for feeding paper with perforations spaced at a given pitch which comprises an endless belt having pins spaced at said pitch which enter the perforations and also having spaced lugs, said pins and lugs being respectively disposed on first and second sides of said belt which are opposite to each other, said belt being subject to a load due to force applied thereto by said paper and being characterized as being sufficiently flexible to enable the pitch between said pins to vary when said belt is in unstressed condition when said load is released, a belt drive sprocket having an outer periphery, spaced receptacles along said outer periphery, said sprocket being of sufficient diameter with respect to the spacing of said lugs to engage a plurality of adjacent ones of said lugs, means ahead of and behind said sprocket in the direction of movement of said belt and engagable with said second side of said belt for defining a path for said belt extending around said sprocket and said path defining means, said path having first, second and third sections defined by said sprocket and said path defining means in which the load is polarized between said first and second sections such that one of said first and second sections is stressed while the other is in the unstressed condition for a low load entry of said pins on said belt in said other of said sections into said perforations, said first and second sections both being engagable simultaneously with the paper and being disposed between said sprocket and said path defining means, and said third section being disposed between said first and second sections and being spaced from said drive sprocket such that said belt in said third section is out of engagement with said drive sprocket and, wherein said sprocket is driven at a speed sufficient to feed said paper at a first speed, and further comprising means for engaging and feeding said paper at a second speed higher than said first speed and disposed downstream of said tractor.

14. The apparatus according to claim 13 wherein said engaging and feeding means is a platen around which said paper form is engagable in driving relationship.

* * * * *